United States Patent [19]

Shin et al.

[11] 4,133,519

[45] Jan. 9, 1979

[54] VISE WITH SELECTABLE JAW FACES

[75] Inventors: Kyoung-Ho Shin, No. San-1, Wondang-Ri, Wondang-Myun, Koyang-Kun, Kyungki-Do, Rep. of Korea; Chong-Dai Hwang, Busan, Rep. of Korea

[73] Assignee: Kyoung-Ho Shin, Kyungki-Do, Rep. of Korea

[21] Appl. No.: 834,879

[22] Filed: Sep. 20, 1977

[30] Foreign Application Priority Data

Jan. 24, 1977 [KR] Rep. of Korea ..... 476[U]
Jan. 24, 1977 [KR] Rep. of Korea ..... 477[U]

[51] Int. Cl.[2] ..... B25B 1/22
[52] U.S. Cl. ..... 269/247; 269/279
[58] Field of Search ..... 81/421–424; 269/258, 279–284, 247

[56] References Cited

U.S. PATENT DOCUMENTS

| | | | |
|---|---|---|---|
| 7,343 | 10/1876 | Barnes | 269/247 |
| 2,610,661 | 9/1952 | Romine | 269/258 |
| 2,646,708 | 7/1953 | Nickas, Jr. | 269/279 |

FOREIGN PATENT DOCUMENTS

| | | | |
|---|---|---|---|
| 294798 | 2/1954 | Switzerland | 269/279 |

*Primary Examiner*—Robert C. Watson
*Attorney, Agent, or Firm*—Armstrong, Nikaido, Marmelstein & Kubovcik

[57] ABSTRACT

In a vise, such as now commonly used to hold a workpiece for drilling, cutting and finishing, the stationary main body is provided with a replaceable jaw member having a plurality of jaw faces, and the adjustible jaw body is formed as a jaw unit having a plurality of jaw plates. Both of the jaw member and the jaw unit are adapted to rotate so that any of the jaw faces and/or the jaw plates can be selected off-handedly in accordance with the kind and shape of a workpiece to insure an ideal grip of the piece.

5 Claims, 6 Drawing Figures

FIG. 1
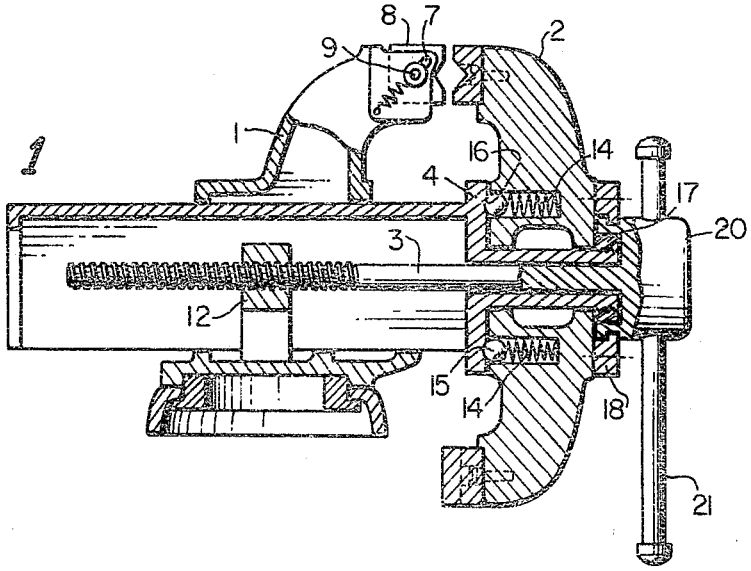
FIG. 2
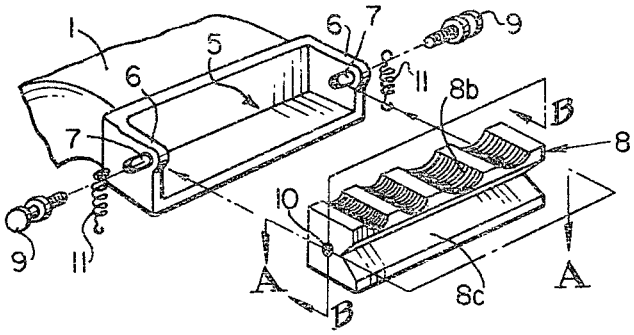
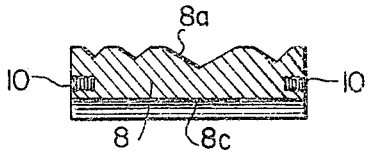
FIG. 3

VISE WITH SELECTABLE JAW FACES

BACKGROUND OF THE INVENTION

This invention relates to a vise to hold a workpiece, and more particularly to an improved vise which is provided with a jaw member having a plurality of jaw faces readily selectable so as to achieve a best advantageous grip of the object workpiece.

A conventional vise, large or small, has a couple of jaw plates, one fixed to the stationary main body and the other to the adjustible body of the vise, and furthermore, said jaw have, in general, notched or serrated faces, which are often proved to be inefficient to insure a secure and positive grip for certain workpieces.

For example, with workpiece that is round, globular, or cylindrical in shape, a conventional vise having fixed and notched jaw faces holds such a workpiece at no more than two linear points or at best along two parallel lines. Therefore, the resultant gripping effect is insufficient for such a workpiece to stand the operation force and consequently, many inconveniences are caused, such as drill failing, surface scratching and even damaging of the piece upon compressing in excess to prevent the piece from slipping; sometimes it becomes a near accident as the workpiece springs wild from the jaws by the operation impact.

It is therefore a general object of the present invention to provide an improved vise with a replaceably mounted jaw member having a plurality of jaw faces in different shapes which can be rotated so as to place selectively into the grip position a jaw face most suitable to insure a slip-proof grip of the particular workpiece without damage.

It is still more specific object of this invention to provide an improved vise which has, as the stationary jaw and/or the adjustible jaw, a replaceably mounted rotatable jaw member having at least two jaw faces of different shapes so that an adequate jaw face can be readily selected at the stationary side and/or the adjustible side of the vise to insure a perfect grip of the workpiece therebetween.

A further object of this invention is to provide an improved vise in which the adjustible jaw body includes as a jaw unit at least two forks, each having a jaw plate at the outermost end thereof, and is adapted to rotate so as to place any of its jaw plates into the adjustible grip position.

SUMMARY OF THE INVENTION

The present invention relates to an improved vise in which the stationary main body includes a jaw member having at least two faces, and the adjustible jaw body includes as a jaw unit at least two forks, each having a jaw plate, characterized in that both of the jaw member and the jaw unit are adapted to rotate so that the most desirable jaw jace and/or jaw plate can be selected to achieve a positive grip of any particular workpiece.

BRIEF DESCRIPTION OF THE DRAWINGS

The above and further objects and novel features of the invention will become more apparent in the following detailed description of the invention as illustrated in the accompanying drawings wherein:

FIG. 1 is a partially cutaway elevational view of a preferred embodiment of the invention;

FIG. 2 is a detailed perspective view to show the relationship between a jaw member and L-shaped recess to receive therewithin said jaw member;

FIG. 3 is a sectional view taken on the Line A—A of the jaw member in FIG. 2;

DETAILED DESCRIPTION OF THE INVENTION

Figures 4, 5:
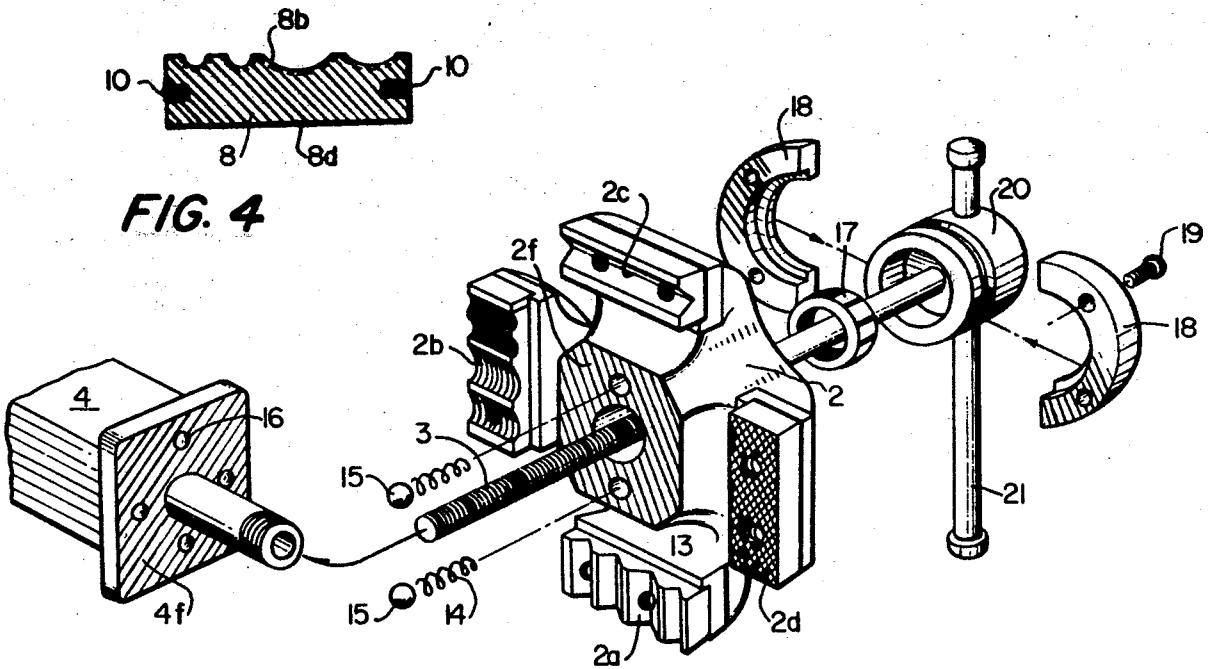
FIG. 4 is a sectional view taken on the Line B—B of the jaw member in FIG. 2.
FIG. 5 is a perspective view of the parts of the adjustible assembly to show relationship thereamong.

Referring to the exemplary embodiment of the invention shown in FIGS. 1–5 inclusive, the vise comprises a stationary main body 1, an adjustible jaw unit 2, and an adjusting screw shaft 3 and a slide piston 4 adapted to facilitate the closing and releasing movement of said adjustible jaw unit.

The stationary main body 1 is provided on the head with a L-shaped recess 5 including side walls 6,6 on which slanting slots 7,7 are formed respectively. A jaw member 8 has four different jaw faces, namely a set of V-grooves **8*a*, a set of circular arc grooves 8*b*, single laid V-groove 8*c* and normal notched or serrated face 8*d*. The jaw member 8 is placed within said recess 5. Fix pins 9,9 are inserted through the slanting slots, and are secured in corresponding threaded holes 10,10 provided on the side end faces of the jaw member, and then springs 11,11** are hooked over the fix pins so as to retain the jaw member urgingly to the stationary main body under compression force of the springs.

The adjustible jaw unit 2 is formed into a Maltese cross configuration having four forks radially extruding from the center thereof as seen in FIG. 5, and jaw plates **2*a*, 2*b*, 2*c* and 2*d* having jaw faces corresponding in shape respectively to those of 8*a*, 8*b*, 8*c* and 8 *d* of said jaw member 8** are secured to the outermost end of each forks by screw means.

Through an opening formed in the center of said adjustible jaw unit 2 the adjusting screw shaft 3 is inserted to the slide piston 4 and is engaged with the female threads provided in a bearing 12 formed integral with the stationary main body 1.

The contacting surface **2*f* of said adjustible jaw unit 2 is provided with apertures 13,13 wherein a set of coil springs 14 and balls are housed, while the contacting surface 4*f* of the slide piston 4 is provided with four check recesses 16 in the positions normal to each other, into which said balls 15 are fitted firmly by the exerting forces of the springs 14 so as to effect the retention of the jaw unit 2** at the predetermined grip position, which function will be described more specifically hereinafter.

Now, as will be seen by reference to FIG. 5, the adjustible jaw unit 2, the adjusting screw shaft 3 and the slide piston 4 are mechanically interconnected by using a ring nut 17, supporting attachments 18,18 and mounting screws 19, the adjusting screw shaft 3 being rotated by a handle lever 21 provided through the head 20 of said shaft so as to facilitate the holding and releasing function of the jaws.

It should be noted that the structure of the vise according to this invention permits the jaw member 8 to turn on the fix pins 9,9 and also permits the adjustible jaw unit 2 to rotate in respect of the adjusting screw shaft 3 so as to bring the most desired jaw face readily to the grip position at the stationary side and/or the adjustible side whereby the most advantageous grip of an object workpiece can be attained.

When an object workpiece is a round one such as a pipe or tubular rod, the jaw member 8 of the stationary side is pulled along the slanting slots 7 against the retaining strength of the coil springs 11 and turned on the fix pins 9 to set in front, for instance, the single laid V-groove jaw face 8*c* at the grip position, and then the adjustible jaw unit 2 is turned either clockwise or counterclockwise in respect of the adjusting screw shaft 3 so as to set the corresponding jaw face 2*c* to the grip position.

It should be understood that when a wiping contact is made between the two surfaces 2*f* and 4*f* by way of turning the jaw unit 2 for selection of a jaw plate, the set of the spring 14 and ball 15 functions in combination with the check recesses 16 as a retention means which defines the grip position and holds said unit 2 at the predetermined position. More specifically, as the check recesses 16 are provided on the contacting surface 4*f* at the points normal to each other as previously stated, the retention balls 15 come to fit into the check recesses by the urging strength of the springs with every right angle movement of the adjustible jaw unit, and thereby the selected jaw plate of the unit can be retained firmly to the predetermined grip position.

Figure 6:
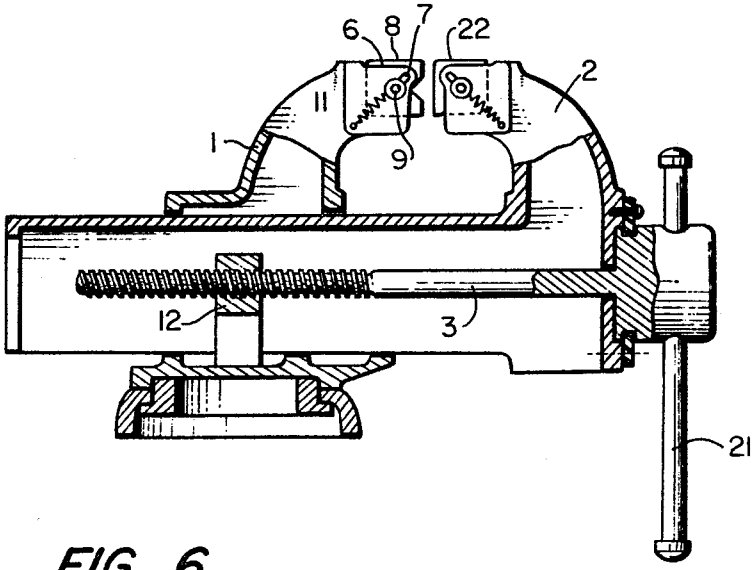
FIG. 6 is an elevational view of another embodiment of the invention.

FIG. 6 illustrates another embodiment of the invention, in which the adjustible jaw body of the conventional type is equipped with a jaw member 22 of the same structure as that of the jaw member 8 provided at the stationary side of a vise according to the first embodiment illustrated in FIGS. 1–5. For the sake of convenience, a specific description of this embodiment is omitted since the structure thereof will be apparent to those skilled in the art by reference to FIG. 6 wherein the corresponding parts are designated by like reference numbers of any other preceding drawings.

It should be added that as a modified embodiment of the present invention, the structure for the jaw member 8 in the first embodiment can also be employed, if necessary, in the adjustible jaw unit 2 in place of any of those fixed jaw plates 2*a*, 2*b*, 2*c* and 2*d*. Furthermore, since the structure of a vise according to this invention provides replaceability of said jaw member 8, such a jaw member can readily be replaced, if desired, with another prefabricated jaw member in stock.

Therefore, any of the vises according to this invention can afford to play the parts of various kinds of conventional vises, insuring slip-proof, stable grip of any oddly shaped workpiece for an easy, safe and acurate operation therefor.

While this invention has been described in detail in its preferred form or embodiment, it will be apparent to persons skilled in the art, after understanding the improvements that various changes and modifications may be made therein without departing from the spirit or scope thereof. It is aimed in the appended claims to cover all such changes and modifications.

What we claim is:

1. A vise comprising:

(a) a main body, said main body including a head portion having an L-shaped recess thereon, said recess being formed by two plate members integral with said main body, and a jaw member rotatably mounted in said L-shaped recess, said jaw member having a plurality of jaw faces thereon;

(b) a slide piston;

(c) an adjustable screw shaft coupling said slide piston to said main body; and (d) an adjustable jaw means mounted on said slide piston, wherein said adjustable jaw means comprises a plurality of jaw plates rotatable about the axis of said adjustable screw shaft, each of said jaw plates having a jaw face corresponding to the jaw faces of said jaw member, whereby one of said jaw faces of said rotatably mounted jaw member is positioned opposite to a corresponding jaw face of said adjustable jaw means to form the jaws of said vise.

2. A vise comprising:

(a) a main body, said main body including a head portion having an L-shaped recess thereon, said recess being formed by two plate members integral with said main body, and a jaw member rotatably mounted in said L-shaped recess, said jaw member having a plurality of jaw faces thereon;

(b) a slide piston;

(c) an adjustable screw shaft coupling said slide piston to said main body; and (d) adjustable jaw means interconnected with said slide piston, said adjustable jaw means including a head portion having an L-shaped recess thereon, said recess being formed by two plate members integral with said main body, and a jaw member rotatably mounted in said L-shaped recess, said jaw member having a plurality of jaw faces thereon which correspond to the jaw faces on the head portion of said main body.

3. A vise comprising:

(a) a main body, said main body including a head portion having an L-shaped recess thereon with end plates on the end of said L-shaped recess, each said end plate having a groove therein, a jaw member, pin means extending through said grooves and into said jaw member for rotatably mounting said jaw member in said L-shaped recess, and resilient means for normally holding said jaw member against one end of said groove to prevent the free rotation thereof, said jaw member having a plurality of jaw faces thereon;

(b) a slide piston;

(c) an adjustable screw shaft coupling said slide piston to said main body; and (d) an adjustable jaw means mounted on said slide piston, wherein said adjustable jaw means comprises a plurality of jaw plates rotatable about the axis of said adjustable screw shaft each of said jaw plates having a jaw face corresponding to the jaw faces of said jaw member, whereby one of said jaw faces of said rotatably mounted jaw member is positioned opposite to a corresponding jaw face of said adjustable jaw means to form the jaws of said vise.

4. A vise comprising:

(a) a main body, said main body including a head portion having an L-shaped recess thereon with end plates on the end of said L-shaped recess, each said end plate having a groove therein, a jaw member, pin means extending through said grooves and into said jaw member for rotatably mounting said jaw member in said L-shaped recess, and resilient means for normally holding said jaw member against one end of said groove to prevent the free rotation thereof, said jaw member having a plurality of jaw faces thereon;

(b) a slide piston;

(c) an adjustable screw shaft coupling said slide piston to said main body; and (d) adjustable jaw means interconnected with said slide piston, said adjustable jaw means including a head portion having an L-shaped recess thereon with end plates on the end of said L-shaped recess, each said end plate having a groove therein, a jaw member, pin means extending through said grooves and into said jaw member for rotatably mounting said jaw member in said L-shaped recess, and resilient means for normally holding said jaw member against one end of said groove to prevent the free rotation thereof, said jaw member having a plurality of jaw faces thereon which correspond to the jaw faces on the head portion of said main body.

5. A vise as set forth in claim 4 wherein said slide piston and said adjustable jaw means are integral.

* * * * *